US005725442A

United States Patent [19]

Higuchi et al.

[11] Patent Number: 5,725,442

[45] Date of Patent: Mar. 10, 1998

[54] MULTI-PIECE SOLID GOLF BALL

[75] Inventors: Hiroshi Higuchi; Hisashi Yamagishi; Junji Hayashi, all of Chichibu, Japan

[73] Assignee: Bridgestone Sports Co., Ltd., Tokyo, Japan

[21] Appl. No.: 661,779

[22] Filed: Jun. 13, 1996

[30] Foreign Application Priority Data

Jun. 14, 1995 [JP] Japan ..... 7-171521

[51] Int. Cl.[6] ..... A63B 37/06; A63B 37/12

[52] U.S. Cl. ..... 473/376; 473/373; 473/378

[58] Field of Search ..... 473/373, 376, 473/378, 374, 372, 377; 273/DIG. 22

[56] References Cited

U.S. PATENT DOCUMENTS

| | | | |
|---|---|---|---|
| 2,939,710 | 6/1960 | Dosmann et al. | 473/373 X |
| 3,908,993 | 9/1975 | Gentiluomo | 473/373 X |
| 4,650,193 | 3/1987 | Molitor et al. | 473/373 |
| 4,683,257 | 7/1987 | Kakiuchi et al. | 473/372 X |
| 4,781,383 | 11/1988 | Kamada et al. | 473/373 |
| 4,858,924 | 8/1989 | Saito et al. | 473/373 |
| 5,273,286 | 12/1993 | Sun | 473/373 |
| 5,439,227 | 8/1995 | Egashira et al. | 473/374 X |
| 5,452,898 | 9/1995 | Yamagishi | 473/377 |
| 5,628,699 | 5/1997 | Maruko et al. | 473/365 X |

*Primary Examiner*—George J. Marlo

*Attorney, Agent, or Firm*—Sughrue, Mion, Zinn, Macpeak & Seas, PLLC

[57] ABSTRACT

A multi-piece solid golf ball comprising a core including an inner sphere and a surrounding layer and a cover enclosing the core and consisting of inner and outer cover layers is provided. The inner sphere has a hardness A expressed by a distortion of 3.5–10.0 mm under a load of 100 kg which is lowest among the ball layers. The outer cover layer has a hardness of at least 58 degrees on Shore D which is highest among the ball layers. Provided that the ball has a hardness B expressed by a distortion under a load of 100 kg, the ratio A/B is between 1.1/1 and 4.0/1. The ball has adequate spin receptivity, good flying performance, durability and a pleasant feel. Less dependence on head speed allows the ball to offer a satisfactory carry to low head speed players.

3 Claims, 1 Drawing Sheet

MULTI-PIECE SOLID GOLF BALL

BACKGROUND OF THE INVENTION

1. Field of the Invention

This invention relates to a multi-piece solid golf ball having a structure of at least four layers and more particularly, to a multi-piece solid golf ball which has improved flying performance, hitting feel, and controllability, especially improved flying performance at low head speeds.

2. Prior Art

Golf balls of various structures are currently on the market. Among others, two-piece solid golf balls and thread-wound golf balls are commonly used in competitions. The two-piece solid golf ball has a rubber based core and an enclosing cover typically of ionomer resin while the thread-wound golf ball is produced by winding thread rubber around a solid or liquid center and enclosing the center with a cover.

The two-piece solid golf balls are used by many ordinary golfers because of superior flying performance and durability although they have the drawbacks including a very hard feel upon hitting and less controllability because of quick separation from the club face upon impact. Because of these drawbacks of two-piece solid golf balls, many professional golfers and skilled amateur golfers favor wound golf balls. As compared with the two-piece solid golf balls, the wound golf balls are superior in feel and control, but inferior in carry and durability. If those golfers with a low head speed including beginners, female players and senior players use wound golf balls, the ball cannot be fully deformed upon hitting and the dependence on head speed increases so that neither an increased carry nor a pleasant feel is expectable. Under the present situation that two-piece solid golf balls and wound golf balls have contradictory characteristics as mentioned above, players make a choice of golf balls depending on their own skill and taste.

Various proposals have been made on solid golf balls in order to develop a new type of three-piece solid golf ball capable of affording a feel close to that of wound golf balls. For the purpose of accomplishing a long carry as well as a hitting feel and controllability close to wound golf balls, Japanese Patent Publication (JP-B) No. 55077/1992 and Japanese Patent Application Kokai (JP-A) No. 80377/1989, for example, disclose a core in which a soft, relatively small inner layer (outer diameter: 24 to 29 mm, hardness: 15° to 30° on Shore D) is enclosed with a hard outer layer (outer diameter: 36 to 41 mm, hardness: 55° to 65° on Shore D). Also for the purpose of improving the hitting feel at no sacrifice of superior flying performance and durability characteristic of solid golf balls, JP-A 24084/1995 discloses the provision of a soft intermediate layer between the center core and the cover or outermost layer of the ball.

However, the above-referred three-piece solid golf ball having a core in which a soft, relatively small inner layer is enclosed with a hard outer layer does not surpass the existing two-piece solid golf balls in flying performance. Since a hard layer is used outside the inner layer, the ball cannot satisfy low head speed players with respect to carry and feel. Because of the great hardness difference between the inner and outer layers, the three-piece solid golf ball is less durable than the existing two-piece solid golf balls. The other above-referred three-piece solid golf ball having a soft intermediate layer between the center core and the cover or outermost layer of the ball has not succeeded in providing a pleasant feel. There is a need to have a golf ball which has a pleasant feel and exerts satisfactory flying performance even when hit by low head speed players.

SUMMARY OF THE INVENTION

Therefore, an object of the present invention is to provide a multi-piece solid golf ball which maintains satisfactory flying performance and durability characteristic of solid golf balls, has a soft feel, receives no excessive spin, minimizes head speed dependence, and exerts satisfactory flying performance even when hit at low head speeds.

To attain this and other objects, we focused on a multi-piece solid golf ball comprising at least four layers and examined the hardness of the inner sphere relative to the hardness of the core, the hardness of the inner sphere relative to the hardness of the ball, and the hardness of the cover. We have found that the objects are achieved when the inner sphere has a hardness expressed by a distortion of 3.5 to 10.0 mm under a load of 100 kg which is lowest among the ball layers, the outer cover layer has a hardness of at least 58 degrees on Shore D which is highest among the ball layers, and the ratio A/B is between 1.1/1 and 4.0/1 wherein A is a hardness of the inner sphere and B is a hardness of the ball, both expressed by a distortion under a load of 100 kg. Due to the synergistic effect of these parameters, the multi-piece solid golf ball maintains satisfactory flying performance and durability characteristic of solid golf balls, has a pleasant soft feel upon hitting, minimizes head speed dependence, and exerts satisfactory flying performance at any head speed. The ball travels an increased distance and affords a pleasant feel even when hit by low head speed players including beginner, female and senior players.

Accordingly, the invention provides a multi-piece solid golf ball comprising a core including an inner sphere and at least one layer surrounding the inner sphere and a cover enclosing the core and consisting of inner and outer cover layers. The inner sphere has a hardness A expressed by a distortion of 3.5 to 10.0 mm under a load of 100 kg which is lowest among the ball layers. The outer cover layer has a hardness of at least 58 degrees on Shore D which is highest among the ball layers. The ratio A/B is between 1.1/1 and 4.0/1 wherein the inner sphere has a hardness A and the ball has a hardness B, both expressed by a distortion under a load of 100 kg.

DETAILED DESCRIPTION OF THE INVENTION

Figure 1:
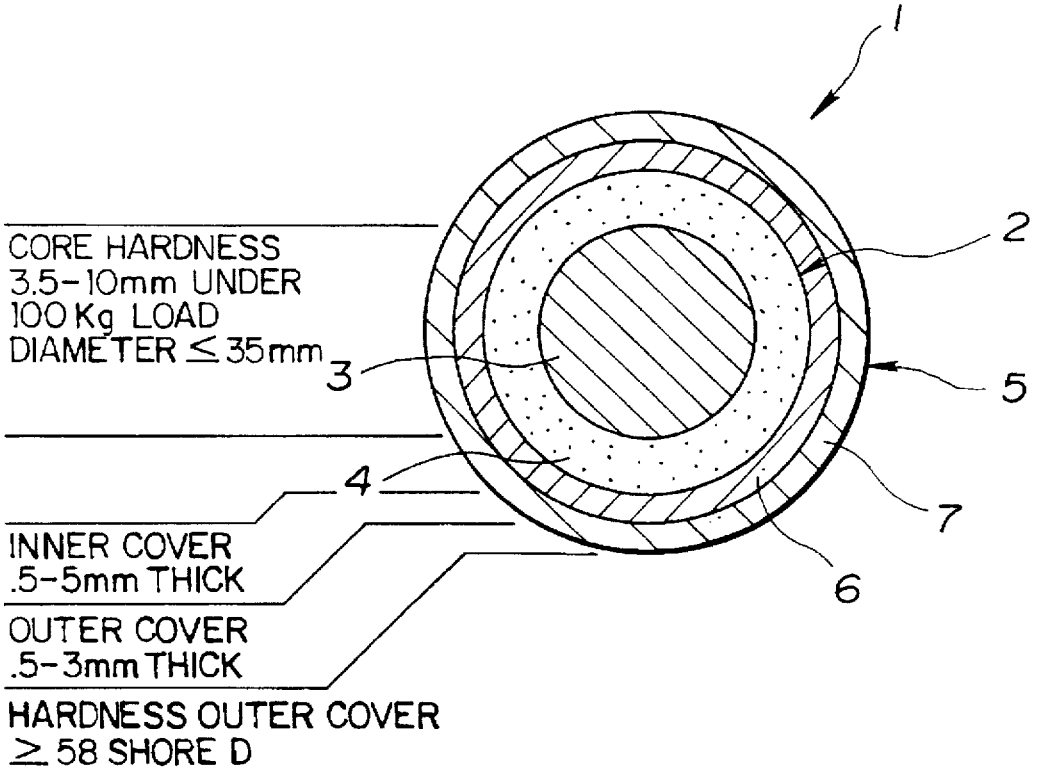
FIG. 1 is a schematic cross section of one exemplary multi-piece solid golf ball according to the invention.

Referring to FIG. 1, there is illustrated one exemplary structure of the golf ball according to the invention. The ball generally designated at 1 includes a solid core 2 consisting of an inner sphere 3 and a layer 4 surrounding the inner sphere and a cover 5 around the core consisting of inner and outer cover layers 6 and 7. The surrounding layer 4 may be a single layer or have a plurality of layers. In the former case, the golf ball is of the four layer structure. According to the feature of the invention, the outer cover layer 7 is hardest and the inner sphere 3 is softest among the ball layers.

The outer cover layer 7 is formed to a Shore D hardness of at least 58 degrees, preferably 60 to 80 degrees, more preferably 60 to 70 degrees. With a hardness of less than 58 degrees, the ball is reduced in restitution or repulsion, failing to provide satisfactory flying performance. The inner cover layer 6 preferably has a Shore D hardness of up to 57 degrees, more preferably 35 to 56 degrees. If the inner cover layer hardness exceeds 57 degrees, the ball would travel a shorter carry at low head speeds and offer a rather hard feel. If the inner cover layer hardness is less than 35 degrees, the ball would be reduced in restitution.

The inner cover layer 6 is formed softer than the outer cover layer 7. The objects of the invention are not achieved if the inner cover layer 6 is harder than the outer cover layer 7. It is recommended for the objects of the invention that the inner cover layer 6 is softer than the outer cover layer 7 by a hardness difference of at least 5 degrees, more preferably 5 to 30 degrees, most preferably 5 to 20 degrees on Shore D scale.

Preferably the outer cover layer 7 has a gage (or radial thickness) of 0.5 to 3.0 mm, especially 1.0 to 2.5 mm, the inner cover layer 6 has a gage of 0.5 to 5.0 mm, especially 1.0 to 4.0 mm, and the entire cover 5 has a gage of 1.0 to 8.0 mm, especially 2.0 to 6.5 mm. If the outer cover layer 7 is too thin, the ball would be less durable. If the outer cover layer 7 is too thick, restitution would be lost. If the inner cover layer 6 is too thin, the feel is exacerbated. If the inner cover layer 6 is too thick, restitution would be lost. If the entire cover 5 is too thin, the ball would be less durable and poor in feel. If the entire cover 5 is too thick, restitution would be lost, failing to provide satisfactory flying performance.

The inner and outer cover layers 6 and 7 may be formed to the above-defined hardness using thermoplastic resins such as ionomer resins and non-ionomer resins alone or in admixture.

In the core 2, the inner sphere 3 has a hardness expressed by a distortion of 3.5 to 10.0 mm, especially 4.0 to 9.5 mm under a load of 100 kg. Also preferably the inner sphere 3 undergoes a distortion of 1.74 to 5.40 mm, especially 2.02 to 5.11 mm under a load of 30 kg. If the inner sphere 3 has a too low hardness, restitution would be lost, failing to provide a satisfactory carry. If the inner sphere 3 has a too high hardness, the feel would be exacerbated. It is noted that the inner sphere 3 preferably has a hardness of 10 to 55 degrees, especially 15 to 50 degrees on Shore D.

Like the core of prior art two-piece solid golf balls, the inner sphere 3 may be formed of a rubber material based on polybutadiene which is vulcanized with an organic peroxide with the aid of a crosslinking agent such as zinc (meth) acrylate.

The surrounding layer 4 around the inner sphere 3 preferably has a hardness of 45 to 70 degrees, especially 48 to 69 degrees on Shore D. It is preferred that the hardness of the surrounding layer 4 be greater than the hardness of the inner sphere 3, both expressed on Shore D scale, for compensating for the short restitution of the very soft inner sphere 3. The core 2 having the inner sphere 3 and the surrounding layer 4 combined preferably has a hardness expressed by a distortion of 2.8 to 6.5 mm, especially 3.0 to 5.5 mm under a load of 100 kg. Better results are obtained when the core 2 undergoes a distortion of 1.35 to 3.43 mm, especially 1.46 to 2.87 mm under a load of 30 kg.

The inner sphere 3 should preferably have a diameter of up to 35 mm, especially 15 to 34 mm. If the inner sphere 3 is too small, restitution would be insufficient. If the inner sphere 3 is too large, the hitting feel would be exacerbated. The core 2 preferably has a diameter of 30 to 39 mm, especially 32 to 38 mm.

The surrounding layer 4 may be formed mainly of thermoplastic resins such as ionomer resins or rubber base materials like the inner sphere 3.

Provided that the inner sphere 3 and the golf ball have a hardness A and B, respectively, both expressed by a distortion under a load of 100 kg, the ratio A/B preferably lies between 1.1/1 and 4.0/1, especially between 1.2/1 and 3.5/1. If the ratio A/B is less than 1.1, both the hitting feel and restitution are not satisfied at the same time. If the ratio A/B is more than 4.0, satisfactory restitution is lost, leading to a short carry. It is noted that the golf ball preferably undergoes a compression or distortion of 2.3 to 4.5 mm, especially 2.5 to 4.0 mm under a load of 100 kg.

In the practice of the invention, the material and preparation of the core are not critical. Any of well-known materials and methods may be used insofar as the above-mentioned golf ball properties are achievable.

More particularly, the inner sphere of the core of the golf ball according to the invention may be prepared by a conventional technique while properly adjusting vulcanizing conditions and formulation. Usually the inner sphere is formed of a composition comprising a base rubber, a crosslinking agent, a co-crosslinking agent, and an inert filler. The base rubber may be selected from natural rubber and synthetic rubbers used in conventional solid golf balls. The preferred base rubber is 1,4-polybutadiene having at least 40% of cis-structure. The polybutadiene may be blended with natural rubber, polyisoprene rubber, styrene-butadiene rubber or the like. The crosslinking agent is typically selected from organic peroxides such as dicumyl peroxide and di-t-butyl peroxide, especially dicumyl peroxide. About 0.5 to 1.0 part by weight of the crosslinking agent is blended with 100 parts by weight of the base rubber. The co-crosslinking agent is typically selected from metal salts of unsaturated fatty acids, inter alia, zinc and magnesium salts of unsaturated fatty acids having 3 to 8 carbon atoms (e.g., acrylic acid and meth-acrylic acid) though not limited thereto. Zinc acrylate is especially preferred. About 5 to 50 parts by weight of the co-crosslinking agent is blended with 100 parts by weight of the base rubber. Examples of the inert filler include zinc oxide, barium sulfate, silica, calcium carbonate, and zinc carbonate, with zinc oxide and barium sulfate being often used. The amount of the filler blended is preferably about 5 to about 100 parts by weight per 100 parts by weight of the base rubber. In the practice of the invention, the amount of the filler (typically zinc oxide and barium sulfate) is properly selected so as to provide the desired hardness to the inner sphere.

An inner sphere-forming composition is prepared by kneading the above-mentioned components in a conventional mixer such as a Banbury mixer and roll mill, and it is compression or injection molded in an inner sphere mold. The molding is then cured by heating at a sufficient temperature for the crosslinking agent and co-crosslinking agent to function (for example, a temperature of about 130° to 170° C. for a combination of dicumyl peroxide as the crosslinking agent and zinc acrylate as the co-crosslinking agent), obtaining an inner sphere.

Where the solid core consists of an inner sphere and a single surrounding layer as in three-piece golf balls, the surrounding layer may be formed of a rubber composition similar to the composition used for the inner sphere or another resin composition based on an ionomer resin or the like. The surrounding layer can be formed on the inner sphere by compression molding or injection molding. Where more than one surrounding layer is included, they may be similarly formed.

The materials of which the inner and outer cover layers are formed are not critical. These layers may be formed of any of well-known cover materials, especially ionomer resin based materials. Desired properties are conveniently obtained using a mixture of two or more ionomer resins. If desired, well-known additives such as pigments, dispersants, anti-oxidants, UV absorbers, UV stabilizers, and plasticizers may be added to the ionomer resin(s). The cover composition may be molded over the solid core by any desired method, for example, by surrounding the core by a pair of preformed hemispherical cups followed by heat compression molding or by injection molding the cover composition over the core.

Like conventional golf balls, the golf ball of the invention is formed with a multiplicity of dimples in the cover surface. The geometrical arrangement of dimples may be octahedral, eicosahedral or the like while the dimple pattern may be selected from square, hexagon, pentagon, and triangle patterns.

The golf ball of the invention is prepared in accordance with the Rules of Golf, that is, to a diameter of at least 42.67 mm for the large size (or a diameter of at least 41.15 mm for the small size) and a weight of not greater than 45.93 grams.

There has been described a multi-piece solid golf ball which has adequate spin receptivity characteristic of solid golf balls, good flying performance, durability and a pleasant feel. Because of less dependence on head speed, the ball offers a satisfactory carry to even those golfers who swing at a low head speed.

EXAMPLE

Examples of the present invention are given below by way of illustration and not by way of limitation. All parts are by weight.

Examples 1–5 & Comparative Examples 1–4

Golf balls were prepared by the following procedure. An inner sphere was prepared by milling an inner sphere-forming rubber composition of the formulation shown in Table 1 in a roll mill and compression molding it at 155° C. for 15 minutes. A surrounding layer was molded over the inner sphere to form a core, using a layer-forming composition of the formulation shown in Table 1. Some surrounding layers were formed from a rubber base material while the remaining layers were formed from a thermoplastic resin. In the case of a rubber base material, the components were milled in a roll mill, molded into half shells in semi-vulcanized, state. The inner sphere was enclosed with the half shells, which were compression molded again at 155° C. for 15 minutes, yielding a core (Examples 2 to 5). A thermoplastic resin was injection molded over the inner sphere to yield a core (Example 1 and Comparative Example 4).

Inner and outer cover layer-forming compositions of the formulation shown in Table 1 were successively injection molded over the core, completing a golf ball.

It is noted that all the amounts of components reported in Table 1 are parts by weight and they are independently expressed in each of the inner sphere, surrounding layer, and cover layers.

TABLE 1

| | E1 | E2 | E3 | E4 | E5 | CE 1 | CE 2 | CE 3 | CE 4 |
|---|---|---|---|---|---|---|---|---|---|
| | | | Core | | | | | | |
| Inner sphere composition | | | | | | | | | |
| 1,4-polybutadiene (cis structure) | 100 | 100 | 100 | 100 | 100 | 100 | 100 | 100 | 100 |
| Zinc acrylate | 18.5 | 13.0 | 25.0 | 11.0 | 21.0 | 18.5 | 32.5 | 31.0 | 16.0 |
| Dicumyl peroxide | 0.9 | 0.9 | 0.9 | 0.9 | 0.9 | 0.9 | 0.9 | 0.9 | 0.9 |
| Anti-oxidant | 0.2 | 0.2 | 0.2 | 0.2 | 0.2 | 0.2 | 0.2 | 0.2 | 0.2 |
| Zinc oxide | 5 | 5 | 5 | 5 | 5 | 5 | 5 | 5 | 5 |
| Barium sulfate | 43.5 | 28 | 24.5 | 32 | 2.5 | 24 | 18 | 20.5 | 142 |
| | Surrounding layer composition | | | | | | | | |
| Thermoplastic resin | | | | | | | | | |
| Himilan 1601 | 50 | — | — | — | — | — | — | — | — |
| Himilan 1557 | 50 | — | — | — | — | — | — | — | — |
| Himilan 1605 | — | — | — | — | — | — | — | — | 50 |
| Himilan 1706 | — | — | — | — | — | — | — | — | 50 |
| Rubber material | | | | | | | | | |
| 1,4-polybutadiene (cis structure) | — | 100 | 100 | 100 | 100 | — | — | — | — |
| Zinc acrylate | — | 46 | 29 | 50 | 29 | — | — | — | — |
| Dicumyl peroxide | — | 0.9 | 0.9 | 0.9 | 0.9 | — | — | — | — |
| Anti-oxidant | — | 0.2 | 0.2 | 0.2 | 0.2 | — | — | — | — |
| Zinc oxide | — | 5 | 5 | 5 | 5 | — | — | — | — |
| Barium sulfate | — | 14 | 23 | 16 | — | — | — | — | — |
| | | | Cover | | | | | | |
| Inner layer composition | | | | | | | | | |
| Hytrel 4047 | 100 | — | — | — | — | — | — | 100 | — |
| Hytrel 4767 | — | 100 | — | 100 | — | — | — | — | — |
| Hytrel 5557 | — | — | 100 | — | 100 | — | — | — | — |
| Outer layer composition | | | | | | | | | |
| Himilan AM7317 | — | — | — | 50 | — | 50 | — | — | 50 |

TABLE 1-continued

| | E1 | E2 | E3 | E4 | E5 | CE 1 | CE 2 | CE 3 | CE 4 |
|---|---|---|---|---|---|---|---|---|---|
| Himilan AM7318 | — | — | — | 50 | — | 50 | — | — | 50 |
| Himilan 1605 | 50 | 50 | — | — | 50 | — | — | 50 | — |
| Himilan 1706 | 50 | 50 | — | — | 50 | — | 50 | 50 | — |
| Himilan 1601 | — | — | 50 | — | — | — | — | — | — |
| Himilan 1557 | — | — | 50 | — | — | — | — | — | — |
| Surlyn 8120 | — | — | — | — | — | — | 50 | — | — |

The golf balls were examined for spin, carry, total distance, angle, and feel by hitting the balls with a driver (#W1) at a head speed (HS) of 45 m/sec. and 35 m/sec. The results are shown in Table 2.

Three professional golfers who swung at a head speed of 45 m/sec. and female top amateur golfers who swung at a head speed of 35 m/sec. actually hit the golf balls to examine their hitting feel. The ball was rated "◎" when it was felt very soft, "O" when soft, "Δ" when a little hard, and "X" when hard.

TABLE 2

| | E1 | E2 | E3 | E4 | E5 | CE 1 | CE 2 | CE 3 | CE 4 |
|---|---|---|---|---|---|---|---|---|---|
| Inner sphere | | | | | | | | | |
| Diameter (mm) | 30.9 | 26.0 | 28.0 | 20.0 | 30.0 | 38.5 | 38.5 | 35.3 | 24.4 |
| (A)Hardness* @100 kg | 6.0 | 8.0 | 4.5 | 9.0 | 5.5 | 6.0 | 3.0 | 3.3 | 6.9 |
| Hardness** @30 kg | 3.15 | 4.27 | 2.30 | 4.83 | 2.87 | 3.15 | 1.46 | 1.63 | 3.65 |
| Surrounding layer | | | | | | | | | |
| Diameter (mm) | 35.3 | 35.3 | 34.1 | 32.1 | 36.4 | — | — | — | 38.3 |
| Shore D | 62 | 60 | 50 | 61 | 50 | — | — | — | 64 |
| Core | | | | | | | | | |
| Hardness* @100 kg | 3.8 | 4.7 | 4.2 | 4.2 | 4.8 | — | — | — | 4.4 |
| Inner cover layer | | | | | | | | | |
| Gage (mm) | 1.7 | 1.7 | 2.3 | 3.3 | 1.5 | — | — | 1.7 | — |
| Shore D | 40 | 47 | 55 | 45 | 55 | — | — | 40 | — |
| Outer cover layer | | | | | | | | | |
| Gage (mm) | 2.0 | 2.0 | 2.0 | 2.0 | 2.3 | 2.1 | 2.1 | 2.0 | 2.2 |
| Shore D | 65 | 65 | 62 | 68 | 65 | 68 | 55 | 65 | 67 |
| Ball | | | | | | | | | |
| Diameter (mm) | 42.7 | 42.7 | 42.7 | 42.7 | 44.0 | 42.7 | 42.7 | 42.7 | 42.7 |
| (B)Hardness* @100 kg | 2.5 | 2.8 | 3.1 | 2.9 | 3.6 | 4.0 | 2.7 | 2.5 | 3.3 |
| A/B | 2.40 | 2.86 | 1.45 | 3.10 | 1.53 | 1.50 | 1.11 | 1.32 | 2.09 |
| #W1/HS45 | | | | | | | | | |
| Spin (rpm) | 2410 | 2320 | 2340 | 2270 | 2290 | 2060 | 2910 | 2680 | 2020 |
| Carry (m) | 211.4 | 211 | 210.8 | 210.7 | 210.6 | 206.2 | 210.3 | 209.8 | 207.9 |
| Total (m) | 225.8 | 225.7 | 225.3 | 226.2 | 225.3 | 222.3 | 223.7 | 224 | 223.1 |
| Angle (°) | 12.6 | 12.5 | 12.5 | 12.4 | 12.4 | 12.2 | 12.9 | 12.8 | 12.3 |
| Feel | ◎ | ◎ | ◎ | ◎ | ◎ | ◎ | Δ | o | ◎ |
| #W1/HS35 | | | | | | | | | |
| Spin (rpm) | 4170 | 4080 | 4160 | 4010 | 4120 | 3870 | 4320 | 4260 | 3920 |
| Carry (m) | 143.2 | 143.8 | 143.5 | 144.1 | 143.6 | 139.2 | 139.5 | 141.3 | 139.2 |
| Total (m) | 155.3 | 155.4 | 155.6 | 155.8 | 155.2 | 149.8 | 147.6 | 150.5 | 149.5 |
| Angle (°) | 13.2 | 13.1 | 13.2 | 13 | 13.2 | 12.8 | 13.6 | 13.3 | 12.9 |
| Feel | ◎ | ◎ | ◎ | ◎ | ◎ | ◎ | x | Δ | Δ |

*a distortion (mm) under a load of 100 kg
**a distortion (mm) under a load of 30 kg As is evident from Table 2, the golf balls of the invention can travel a longer distance whether the head speed is high (45 m/sec.) or low (35 m/sec.) and offer a pleasant feel on hitting.

Japanese Patent Application No. 171521/1995 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A multi-piece solid golf ball comprising a core including an inner sphere and at least one layer surrounding the inner sphere and a cover enclosing the core and consisting of inner and outer cover layers, characterized in that said inner sphere has a hardness A expressed by a distortion of 3.5 to 10.0 mm under a load of 100 kg which is lowest among the ball layers, said outer cover layer has a hardness of at least 58 degrees on Shore D which is highest among the ball layers, and the ratio A/B is between 1.1/1 and 4.0/1 wherein said inner sphere has a hardness A and said ball has a hardness B, both expressed by a distortion under a load of 100 kg.

2. The golf ball of claim 1 wherein said inner sphere has a diameter of up to 35 mm, said core has a diameter of 30 to 39 mm, said inner sphere has a lower Shore D hardness than said surrounding layer, and said core has a distortion of 2.8 to 6.5 mm under a load of 100 kg.

3. The golf ball of claim 1 wherein said outer cover layer has a gage of 0.5 to 3.0 mm, said inner cover layer has a gage of 0.5 to 5.0 mm, and said inner cover layer has a hardness of up to 57 degrees on Shore D.

* * * * *